US005480335A

United States Patent [19]

Caveza

[11] Patent Number: 5,480,335

[45] Date of Patent: Jan. 2, 1996

[54] TOY FOR MAKING SIMULATED FRENCH FRIES FROM CHEWING GUM STICKS

[75] Inventor: Martin J. Caveza, Redondo Beach, Calif.

[73] Assignee: Mattel, Inc., El Segundo, Calif.

[21] Appl. No.: 383,154

[22] Filed: Feb. 2, 1995

[51] Int. Cl.[6] ..... A63H 33/30

[52] U.S. Cl. ..... 446/75; 446/479; 446/491; 426/104

[58] Field of Search ..... 446/71, 75, 475, 446/479, 481, 491; 434/127; 83/425.3; 426/104

[56] References Cited

U.S. PATENT DOCUMENTS

| | | | |
|---|---|---|---|
| 2,084,921 | 6/1937 | Skliris | 83/425.3 |
| 2,148,782 | 2/1939 | Spang | 83/425.3 |
| 2,547,249 | 4/1951 | Bell . | |
| 2,672,706 | 3/1954 | Hayley . | |
| 4,003,142 | 1/1977 | Morrison et al. . | |
| 4,581,904 | 4/1986 | Lehmann et al. . | |
| 4,599,928 | 7/1986 | Oker . | |
| 4,753,346 | 6/1988 | Tsuji . | |
| 4,865,574 | 9/1989 | Kobayashi . | |
| 4,870,756 | 10/1989 | Burkhalter . | |
| 5,036,590 | 8/1991 | Reinke et al. . | |
| 5,075,973 | 12/1991 | Börner . | |
| 5,098,327 | 3/1992 | Ferrero . | |
| 5,104,124 | 4/1992 | Bernard et al. . | |
| 5,115,568 | 5/1992 | Aida . | |
| 5,152,710 | 10/1992 | Montgomery . | |
| 5,213,504 | 5/1993 | Lee et al. . | |
| 5,346,423 | 9/1994 | Caveza | 446/479 |

*Primary Examiner*—Robert A. Hafer
*Assistant Examiner*—Jeffrey D. Carlson
*Attorney, Agent, or Firm*—Roy A. Ekstrand

[57] ABSTRACT

A toy includes a clam shell case having a hingedly coupled base and cover member which in the open configuration supports the remaining toy components. A hand crank operated shredder is securable to the open case and is operative to receive and shred a plurality of chewing gum sticks to form elongated ribbons of chewing gum. A holder replicating a conventional fast food french fry envelope or carton receives the chewing gum ribbons to provide the appearance of a pair of french fry orders from a fast food type restaurant. The gum shredder and holder are receivable within the interior of the folding case and are enclosed therein when the case is closed.

8 Claims, 2 Drawing Sheets

TOY FOR MAKING SIMULATED FRENCH FRIES FROM CHEWING GUM STICKS

FIELD OF THE INVENTION

This invention relates generally to toy products which simulate food preparation and particularly to those which mimic fast food preparation.

BACKGROUND OF THE INVENTION

Toy products which simulate food preparation are an extremely popular toy category and, as a result, have enjoyed substantial variation and product development on the part of practitioners in the art. Some toy products utilize nonedible simulated food items and articles such as wooden or plastic items having an appearance corresponding to one or more food items. Other types of such toy products provide and process an edible food such as pudding mixes, cookies, jellies and jams or the like used in various simulated food preparations. In addition, certain toy food preparation products actually provide cooking processes usually employing an electric heater such as a lightbulb or the like for a heat source. Such products having actual heating elements, of course, give rise to potential safety problems particularly if the product is intended for operation by younger children. Practitioners have attempted to avoid such safety problems by providing toy products which process edible food but which rely upon other mechanisms for imparting the realistic cooking appearance to the food preparation.

In addition to variations of such toy products directed to the product itself, practitioners in the art have also endeavored to provide a variety of toy playsets receivable within a compact carrying case. In some such products, the carrying case forms an integral portion of the play apparatus of the toy set.

For example, U.S. Pat. No. 4,581,904 issued to Lehmann, et al. sets forth a TOY JEWELRY ITEM WITH PARTS MOVABLE TO A HIDDEN POSITION in which a pair of clam shell portions are hingedly coupled to form a carrying case. The various parts such as head, hands, feet or the like are securable to the clam shell portions in either exposed or hidden positions.

U.S. Pat. No. 5,213,504 issued to Lee, et al. sets forth a COLORING TOY having a plastic box housing a plurality of markers. The outer surface of the box forms a writing surface upon which the markers may be used to draw or write. The interior of the box supports a plurality of markers as well as a plurality of other writing apparatus such as stencils or the like.

U.S. Pat. No. 5,104,124 issued to Bernard, et al. sets forth a COLLAPSIBLE GAME USABLE AS A PROMOTIONAL DEVICE having a rear face secured to the rear of a box or like container. A second panel is integrally formed and pivotally supported about the bottom edge of the first panel and movable between retracted and extending positions. The panels are formed of paper stock along with the box and support game play elements which may be folded into the box or extended therefrom for game play.

U.S. Pat. No. 4,753,346 issued to Tsuji sets forth an AUTOMOBILE-SHAPED CASE FOR DESK ACCESSORIES having an automobile-like lower body defining a plurality of appearance features corresponding to an automobile and having a plurality of interior compartments within which various desk items may be stored.

U.S. Pat. No. 2,627,706 issued to Hayley sets forth a COMBINATION CONTAINER AND TELEVISION TOY having a rectangular box-like container defining an open side within which a room interior setting is depicted. The room depiction includes a simulated television set having a screen aperture therethrough together with means for receiving an elongated multi-imaged film strip which is moved through the simulated television to provide a succession of television-like images.

U.S. Pat. No. 5,098,327 issued to Ferrero sets forth a COMBINATION GIFT AND ITS CASING having a single molded plastic unit defining a hollow clam shell casing to which a plurality of gift objects are integrally formed and foldable to the interior thereof. The entire assembly may be folded to close the clam shell halves and enclose the molded gift components.

U.S. Pat. No. 4,865,574 issued to Kobayashi sets forth an AMUSEMENT AND INSTRUCTIONAL DEVICE having a succession of planar display panels hingedly connected to collectively provide a book-like structure. The panels display words, pictures or the like.

U.S. Pat. No. 5,152,710 issued to Montgomery sets forth a FOLD OPEN PLAYSET WITH SLOTTED BASE in which a container for a toy or game in the form of a box having two parts hingedly coupled may be used as a base plate for supporting parts within the box as the completed toy is erected from the parts.

U.S. Pat. No. 4,599,928 issued to Koer sets forth an APPARATUS FOR FORMING CUBES FROM A PRODUCT SUCH AS A LOAF OF CHEESE having a base member supporting a hinge frame which in turn supports a plurality of cutting filaments in a parallel spaced array. The cutter further includes a second hingedly coupled frame supporting a second plurality of cutting filaments in a parallel array orthogonal to the first array.

U.S. Pat. No. 5,115,568 issued to Aida sets forth a CUTTER FOR CUTTING THE FOLDED EDGE OF FOLDED PAPER SHEETS OR THE LIKE having a box-like casing a channel-like groove provided in the casing along one edge thereof for receiving a folded paper edge. A cutter blade holder carrying a cutter blade is receivable within the channel to cut the folded paper.

U.S. Pat. No. 5,075,973 issued to Borner sets forth a DEVICE FOR CUTTING FRUIT, VEGETABLES OR THE LIKE INTO SLICES having a blade holding plate defining a front edge and supporting a V-shaped cutter blade.

U.S. Pat. No. 4,003,142 issued to Morrison, et al. sets forth a SCULPTURING KIT AND METHOD FOR PRODUCING DEHYDRATED FORMS FROM HYDRATED ARTICLES having a transparent heating chamber for mounting an article and a support base having an incandescent heating source therein. A drip shield is supported within the housing for preventing liquid from contacting the heat source.

U.S. Pat. No. 2,547,249 issued to Bell sets forth a STRIP CUTTER having a housing supporting a plurality of parallely spaced cutting blades together with a guide member for causing a thin material such as paper or the like to be forced against the blades as the material is drawn through the guide and thereby cut into strips.

U.S. Pat. No. 4,870,756 issued to Burkhalter sets forth a STRIP CUTTER for cutting elongated uniform strips of material having a holder supporting members defining a U-shaped channel and a hollow body. A plurality of parallel spacers and blades are mounted upon the body and retained within the chamber.

U.S. Pat. No. 5,036,590 issued to Reinke, et al. sets forth a DECORATIVE RIBBON SLITTER for subdividing a ribbon into shreds of predetermined width. A plurality of longitudinally spaced ribbon shredding teeth are mounted on the inner surface of one of a pair of jaw members for engaging the ribbon in the closed position.

While the foregoing described prior art devices have provided improvement of the art and, in some instances, enjoyed commercial success, there remains nonetheless a continuing need in the art for evermore improved toy products.

SUMMARY OF THE INVENTION

Accordingly, it is a general object of the present invention to provide an improved toy product for producing simulated food items. It is a more particular object of the present invention to provide an improved toy product for making simulated french fries from chewing gum sticks.

In accordance with the present invention, there is provided a toy for making simulated french fries from one or more chewing gum sticks comprising: a case having a pair of case portions and a coupling hinge, the case portions each defining an interior cavity and the case portions pivoting between an overlying closed position and an open coplanar position; a gum shredder alternatively attachable to one of the case portions or receivable within the interior cavity thereof, the gum shredder having means for slicing a stick of gum into a plurality of elongated gum ribbons; and a gum ribbon holder having a first pocket formed therein for receiving a plurality of the gum ribbons to form a simulated french fry order.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
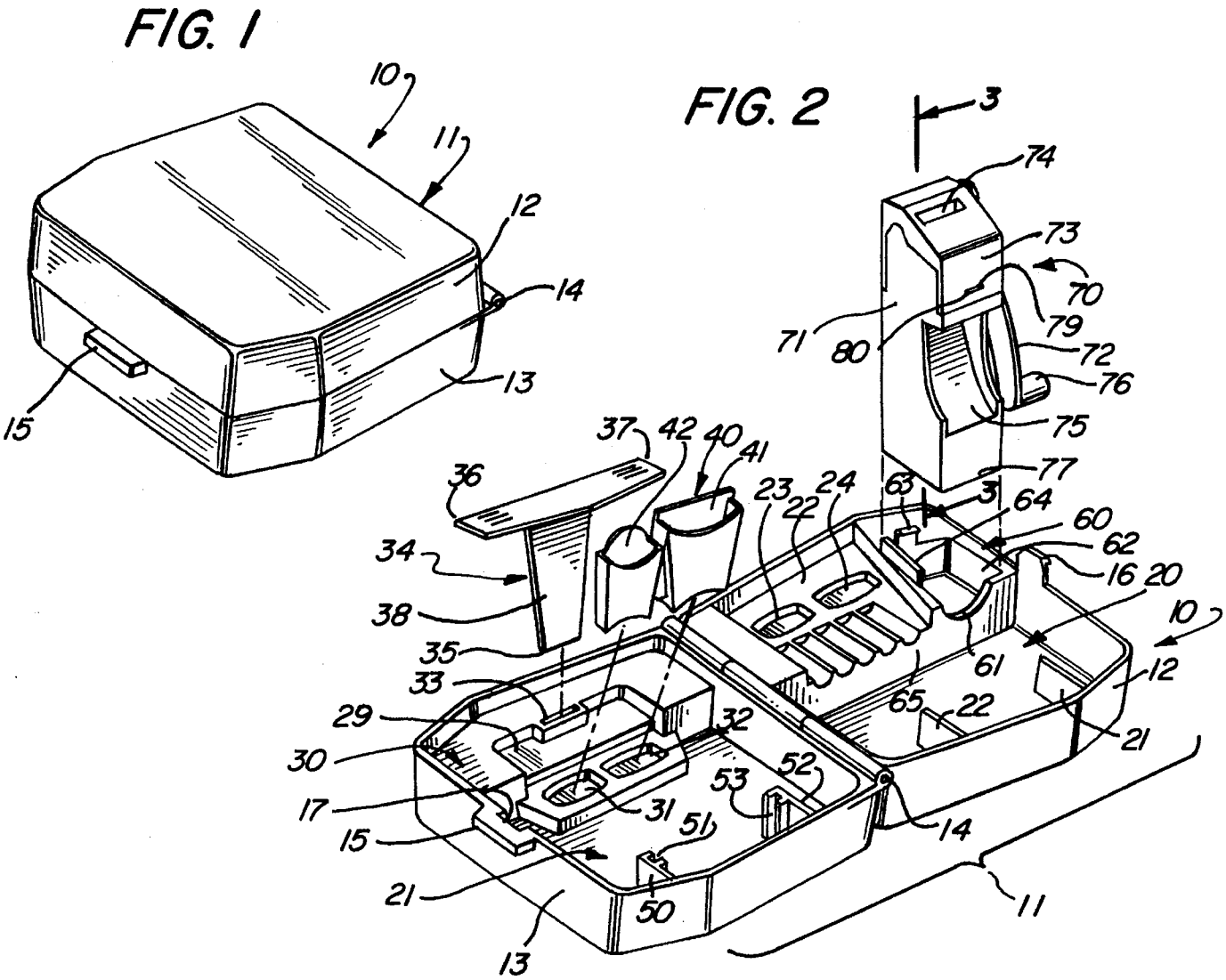
FIG. 1 sets forth a perspective view of the present invention toy product in the closed position.
FIG. 2 sets forth a perspective assembly view of the present invention toy product in the open position.

FIG. 1 sets forth a perspective view of a toy constructed in accordance with the present invention and generally referenced by numeral 10. Toy 10 is shown in FIG. 1 in the closed position and includes a carrying case 11 having a base portion 13 and a cover portion 12 hingedly coupled by a hinge 14. Base 13 further defines a handle 15 extending from the frontal portion thereof. In its preferred form, base 13 and cover 12 are configured in a mirror image fashion such that when positioned in the close position shown in FIG. 1, they combine to form a compact enclosure for the contents within case 11. Case 11 is, in its preferred form, fabricated of a molded plastic material or the like.

FIG. 2 sets forth a perspective assembly view of toy 10 having case 11 in the open position. Thus, as described above, toy 10 includes a case 11 having a base 13 and a cover 12 hingedly coupled by a conventional hinge 14. A notch 17 is formed within handle 15 of base 13. Correspondingly, cover 12 defines an extending clasp 16 sized and configured to be received within notch 17 in a snap-fit coupling which provides secure attachment of cover 12 to base 13 in the closed configuration shown in FIG. 1.

In addition, base 13 defines an interior cavity 21 having a pair of walls 50 and 52 formed therein. Wall 50 defines a vertical groove 51 while wall 52 defines a vertical groove 53. Base 13 further defines a raised tray portion 30 having a recess 29 and an elongated slot 33 formed therein. Base 13 further defines a pair of receptacles 31 and 32.

Cover 12 defines an interior cavity 20 having a pair of spacer walls 21 and 22 formed therein. In addition, cover 12 defines a raised portion 60 having a recessed well 62 formed therein. A pair of clasps 63 and 64 extend upwardly from raised portion 60 on each side of well 62. Raised portion 60 further defines an interior wall 65 which in turn defines a notch 61 extending into well 62. A recess 22 is formed within raised portion 60 and further defines a pair of receptacles 23 and 24.

In accordance with the present invention, toy 10 further includes a gum shredder 70 having a generally rectangular housing 71 supporting a blade cover 73 at the upper portion thereof. Housing 71 further defines a bottom end 77 and a discharge chute 75. Gum shredder 70 further includes a crank arm 72 rotatably supported upon the upper portion of housing 71 and having a handle 76 at the extending end thereof. Blade cover 73 further defines a slot 74 sized and configured to receive a conventional size chewing gum stick and a slot 80. Housing 71 defines an extending tab 79 which is received within slot 80 to secure the front portion of blade cover 73. As is better seen in FIG. 3, blade cover 73 further defines a rear slot 97 while housing 71 defines a corresponding tab 98 received within slot 97 to secure the rear portion of blade cover 73. End 77 of housing 71 is received within well 62 and supported vertically therein. Clasp 63 and 64 provide an engaging pressure against housing 71 to secure gum shredder 70 within well 62.

Toy 10 further includes a simulated warming stand 34 having an upright 38 defining a bottom end 35. End 35 is received within slot 33 of tray portion 30 in a tight slightly interfering fit to provide upright 38 with secure attachment to tray portion 30. Warming stand 34 further includes end portions 36 and 37. Toy 10 further includes a holder 40 which is preferably configured to provide an appearance corresponding to the conventional french fry cartons or pocket holders used in many fast food restaurants. Holder 40 thus provides interior pockets 41 and 42. Holder 40 is received within receptacles 31 and 32 of tray portion 30 in a tight snap-fit or interference fit attachment which maintains holder 40 in a vertical position beneath simulated warming stand 30.

Figures 3, 4, 5:
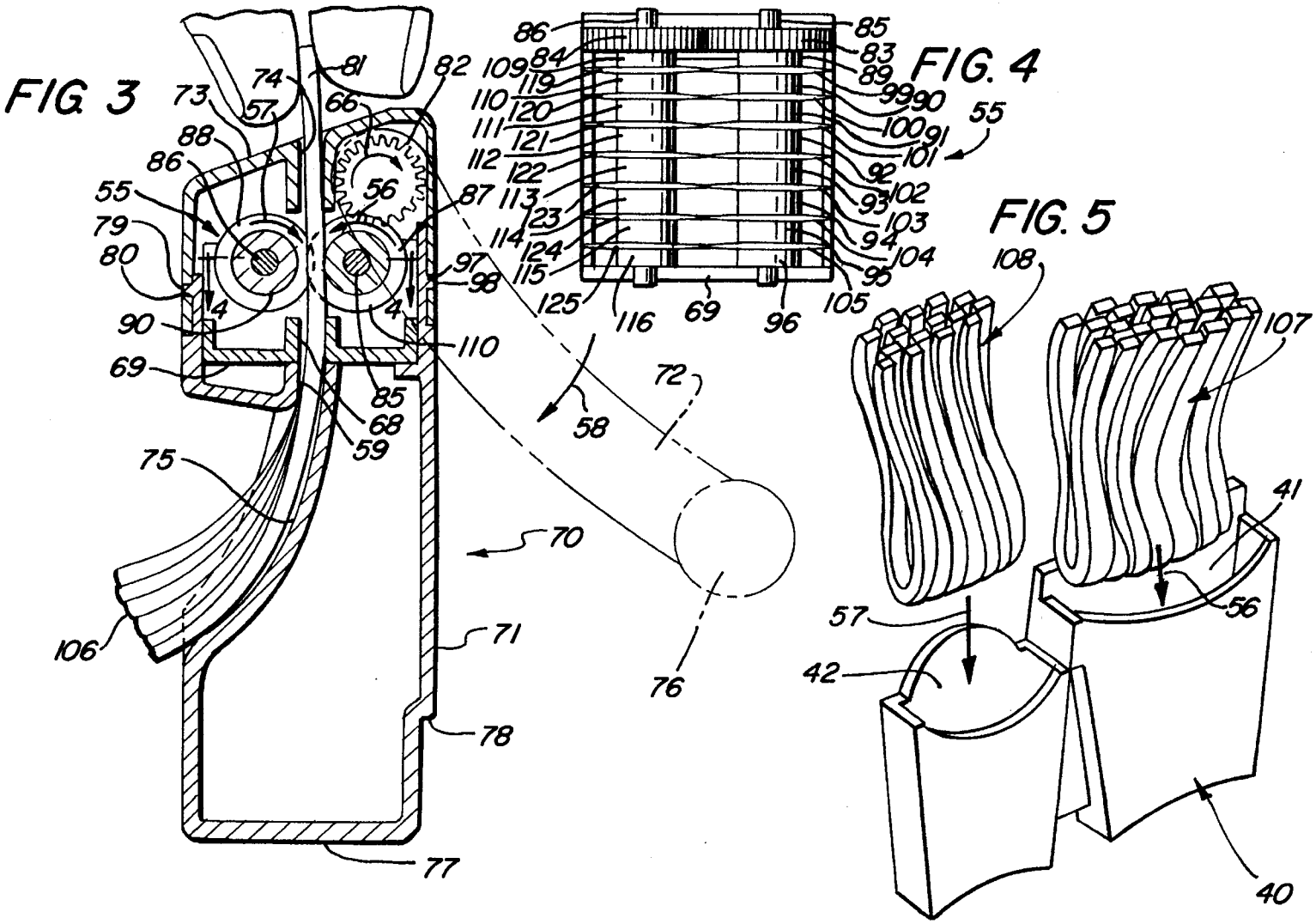
FIG. 3 sets forth a section view of the shredder portion of the present invention toy product taken along section lines 3—3 in FIG. 2.
FIG. 4 sets forth a section view of the cutter portion of the present invention toy product taken along section lines 4—4 in FIG. 3.
FIG. 5 sets forth a perspective assembly view of the simulated french fry container of the present invention toy product.

With toy 10 fully assembled, the child user operates gum shredder 70 by inserting a conventional stick of chewing gum into slot 74 in the manner shown in FIG. 3 and thereafter turning crank arm 72 using handle 76. By means set forth below in greater detail, the turning of crank arm 72 draws the chewing gum stick into blade cover 73 and housing 71 through slot 74 and cuts the chewing gum stick into a plurality of elongated gum ribbons such as ribbons 106 shown in FIG. 3 which descend downwardly through discharge chute 75. The shredded gum ribbons are then folded in half in the manner shown in FIG. 5 and inserted folded end down into pockets 41 and 42 of holder 40. This process may be repeated using several chewing gum sticks to accumulate a sufficient quantity of gum ribbons to generally fill pockets 41 and 42 of holder 40. The resulting configuration of gum ribbons within holder 40 assumes an appearance corresponding to a pair of french fry orders typical of a number of fast food restaurants. It should be noted that holder 40 may alternatively be placed within receptacles 23 and 24 of recess 22 during the shredding process and once filled may be transferred to receptacles 31 and 32 within tray portion 30 at the user's choice.

The resulting shredded gum ribbons may then be retained within holder 40 for continued play. Alternatively, the user may extract some or all of the shredded gum ribbons from holder 40 for chewing or other play activities. The supply of gum ribbons may be continually replenished by shredding additional chewing gum sticks within gum shredder 70.

In accordance with the present invention, toy 10 may be returned to the closed position shown in FIG. 1 by disassembling gum shredder 70, holder 40 and simulated warming stand 34 from cover 12 and base 13 and thereafter placing each element within base 13 and cover 12 to provide enclosure within case 11. More specifically, gum shredder 70 is withdrawn from well 62 and crank arm 72 is rotated to the approximate position shown in FIG. 2. Thereafter, gum shredder 70 is placed within interior 20 of cover 12 between the interior ends of wall 21 and 22 and wall 65 of raised portion 60. When correctly positioned, blade cover 73 is proximate hinge 14 while end 77 is proximate clasp 16. This positioning of gum shredder 70 permits handle 76 to be received within notch 61 of wall 65. Holder 40 is configured to be received within recess 22 when holder 40 is laid upon the upper surface of recess 22 in a generally horizontal orientation. Finally, simulated warming stand 34 is placed within interior 21 of base 13 such that upright 38 rests upon the bottom surface of interior 21 and end 37 is received within groove 51 of wall 50 and end 36 is received within groove 53 of wall 52. In its preferred form of the present invention, ends 36 and 37 of warming stand 34 are sized to provide a snug engaging fit within grooves 53 and 51 thereby retaining warming stand 34 within base 13. Finally, case 11 is closed by pivoting either base 13 or cover 12 or both together engaging clasp 16 within notch 17 and returning toy 10 to the closed configuration shown in FIG. 1.

FIG. 3 sets forth a section view of gum shredder 70 taken along section lines 3—3 in FIG. 2. As described above, gum shredder 70 includes a housing 71 defining a lower end 77 receivable within well 62 (seen in FIG. 2). As is also described above, housing 71 supports a blade cover 73 having an elongated slot 74 formed in the upper portion thereof. Housing 71 further defines a front tab 79 and a rear tab 98. Correspondingly, blade cover 73 defines a slot 80 receiving tab 79 and a slot 97 receiving tab 98 to secure blade cover 73 upon the upper portion of housing 71. Housing 71 further defines an elongated aperture 59 and a curved discharge chute 75 extending downwardly therefrom.

A blade support frame 69 is received within the upper portion of housing 71 and defines an aperture 68 on the lower surface thereof. Aperture 68 is generally coextensive with opening 59 of housing 71. Frame 69 forms the support for a cutter assembly 55, the structure of which is better seen in FIG. 4. However, suffice it to note here that cutter assembly 55 includes a pair of transversely extending shafts 85 and 86 which are rotatably supported by frame 69 on either side of aperture 68. Shaft 85 supports a plurality of cutting blades 99 through 105 having interleaved spacers 89 through 96 respectively, all rotatably supported upon shaft 85. Similarly, shaft 86 supports a plurality of cutting blades 119 through 125 and a plurality of interleaved spacers 109 through 116 respectively. Blades 99 through 105 and 119 through 125 are best seen in FIG. 4 and generally define disk-shaped cutting blades having beveled outer edges in accordance with conventional fabrication techniques.

Returning to FIG. 3, it should be noted that slot 74 formed in blade cover 73 as well as aperture 68 of frame 69 and opening 59 of housing 71 are generally aligned along a common vertical plane. Correspondingly, shafts 85 and 86 are symmetrically positioned with respect to the vertical plane of slot 74, aperture 68 and opening 59 to position their respective cutting blade disks on either side thereof.

In addition and as is better seen in FIG. 4, shafts 85 and 86 are secured to a pair of meshed gears 83 and 84. Gum shredder 70 further includes a gear 82 rotatably supported at the upper portion of housing 71 and coupled to crank arm 72. In addition, gear 82 engages gear 83 (seen in FIG. 4) such that rotation of crank arm 72 and gear 82 causes a corresponding rotation of gear 83 and gear 84. The direct coupling of gears 83 and 84 cause shafts 85 and 86 to rotate in opposite directions as crank arm 72 is rotated with respect to housing 71. Thus, the cutting action of cutter assembly 55 is provided by the user's rotation of crank arm 72 in the direction indicated by arrow 58. As crank arm 72 rotates in the direction indicated by arrow 58, gear 82 rotates in the direction indicated by arrow 66. The engagement of gear 82 with gear 83 and the engagement of gears 83 and 84 (seen in FIG. 4) cause shafts 85 and 86 to be rotated in the directions indicated by arrows 56 and 57 respectively.

In operation, the user inserts a conventional stick of gum 81 through slot 74 downwardly upon the intersection of the cutting blades of cutter assembly 55. Thereafter, the user rotates crank arm 72 in the direction indicated by arrow 58 causing the cutting blades upon shaft 85 to rotate in the direction of arrow 56 and the cutting blades upon shaft 86 to rotate in the direction of arrow 57. This rotation of cutting blades draws gum stick 81 downwardly between the rows of cutting blades forming gum ribbons 106 which pass downwardly through aperture 68 and opening 59 to emerge via discharge chute 75 as elongated gum ribbons. The rotation of crank arm 72 continues until gum stick 81 is entirely severed forming gum ribbons 106.

FIG. 4 sets forth a section view of cutter assembly 55 taken along section lines 4—4 in FIG. 3. As described above, cutter assembly 55 includes a support frame 69 having shafts 85 and 86 rotatably supported therein. Shaft 85 supports a gear 83 and a plurality of disk-shaped cutting blades 99 through 105. Shaft 85 further supports a plurality of interleaved spacers 89 through 96. Correspondingly, shaft 86 supports a gear 84 engaged with gear 83 together with a plurality of cutting blades 119 through 125. Shaft 86 further supports a plurality of interleaved spacers 109 through 116. To provide the optimum cutting action for the present invention gum shredder, blades 99 through 105 are slightly offset with respect to blades 119 through 125 permitting the respective sets of cutting blades within cutter assembly 55 to overlap slightly and provide a more effective cutting action. With temporary reference to FIG. 3, it should be noted that slot 74 is sufficient to pass a chewing gum stick but is far too small to permit the child user's fingers coming in contact with cutter assembly 55.

FIG. 5 sets forth a perspective view of holder 40 receiving a plurality of gum ribbons in accordance with the present invention. Thus, holder 40 as described above includes a pair of pockets 41 and 42 and is generally configured to provide an appearance corresponding to the familiar french fry holder or cartons used in fast food restaurants. A plurality of gum ribbons 107 formed in the above-described manner using shredder 70 are shown folded in half and thereafter inserted downwardly in the direction of arrow 56 into pocket 41. Correspondingly, a plurality of gum ribbons 108 also formed in the above-described manner using gum shredder 70 are inserted into pocket 42 of holder 40 after being folded in half in the direction indicated by arrow 57. The resulting configuration of holder 40 and gum ribbons 107 and 108 provides an appearance very similar to a pair of french fry orders in a conventional fast food restaurant.

What has been shown is a toy for making simulated french fries from chewing gum sticks which employs a novel gum shredder securable to an open case which utilizes a plurality of chewing gum sticks to form gum ribbons which when folded and inserted into a "french fry" holder provides a simulated french fry. The entire toy is supportable within a clam shell carrying case which also functions as the support base for the entire toy.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy for making simulated french fries from one or more chewing gum sticks comprising:

a case having a pair of case portions and a coupling hinge, said case portions capable of pivoting between an overlying closed position and an open coplanar position, said case portions defining a base and a cover and creating an interior cavity when in said closed position;

a gum shredder having means for slicing a stick of gum into a plurality of elongated gum ribbons; said cover having means for snugly receiving said shredder in an operable position and said cavity being sized to house said shredder in a collapsed position and a gum ribbon holder having a first pocket formed therein for receiving a plurality of said gum ribbons to form a simulated french fry order.

2. A toy as set forth in claim 1 wherein said gum shredder includes a crank arm rotatably supported upon said gum shredder and a plurality of rotatable cutting blades operatively coupled to said crank arm.

3. A toy as set forth in claim 2 wherein gum ribbons are receivable within said first pocket of said gum ribbon holder in a folded configuration.

4. A toy as set forth in claim 3 wherein said gum ribbon holder defines a second pocket for receiving a plurality of said gum ribbons.

5. A toy for making simulated french fries from one or more chewing gum sticks comprising:

a case having a base portion defining a first interior cavity therein and a pair of receptacles within said first interior cavity and a cover portion hinged to said base portion and defining a second interior cavity and having a well formed within said second interior cavity;

a gum shredder receivable within said second interior cavity and having a housing defining a gum receiving slot and a lower end receivable within said well to secure said gum shredder to said cover portion, said gum shredder having a pair of rotatable cutter blade arrays beneath said gum receiving slot and crank means for rotating said cutter blade arrays in a converging direction; and a gum ribbon holder having a pair of end portions receivable within said pair of receptacles and a pair of gum ribbon pockets, whereby one or more sticks of gum may be shredded by said gum shredder to a plurality of gum ribbons and wherein said gum ribbons when placed within said pockets assume an appearance suggestive of a plurality of french fries within a fast food restaurant container.

6. A toy as set forth in claim 5 wherein said gum shredder and said gum ribbon holder are capable of being stored within said second interior cavity permitting said cover portion and said base portion to be closed upon each other to enclose said gum ribbon holder and said gum shredder.

7. A toy as set forth in claim 6 further including a generally T-shaped simulated warming stand having a lower end and wherein said base portion includes a slot proximate said pair of receptacles for receiving said lower end and supporting said simulated warming stand upon said base.

8. A toy as set forth in claim 7 wherein said base portion further includes means for securing said simulated warming stand within said first interior cavity when said base portion is closed upon said cover portion.

* * * * *